US011046098B2

(12) United States Patent
Umenai et al.

(10) Patent No.: US 11,046,098 B2
(45) Date of Patent: Jun. 29, 2021

(54) NOISE REDUCING STRUCTURE AND IMAGE FORMING APPARATUS

(71) Applicant: FUJIFILM Business Innovation Corp., Tokyo (JP)

(72) Inventors: Ko Umenai, Kanagawa (JP); Fuyuki Kokubu, Kanagawa (JP); Takayuki Suehiro, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 518 days.

(21) Appl. No.: 15/943,730

(22) Filed: Apr. 3, 2018

(65) Prior Publication Data

US 2019/0092058 A1 Mar. 28, 2019

(30) Foreign Application Priority Data

Sep. 28, 2017 (JP) ..... JP2017-187528

(51) Int. Cl.

| | |
|---|---|
| ***B41J 29/10*** | (2006.01) |
| ***G10K 11/175*** | (2006.01) |
| ***B41J 29/13*** | (2006.01) |
| ***G10K 11/172*** | (2006.01) |
| ***B41J 29/38*** | (2006.01) |

(52) U.S. Cl.

CPC ..... *B41J 29/10* (2013.01); *B41J 29/13* (2013.01); *B41J 29/38* (2013.01); *G10K 11/172* (2013.01); *G10K 11/175* (2013.01); *G10K 2210/1052* (2013.01)

(58) Field of Classification Search

CPC . B41J 29/10; B41J 29/13; B41J 29/38; G10K 11/175; G10K 11/172; G10K 2210/1052

USPC ..... 181/201, 202

See application file for complete search history.

(56) References Cited

U.S. PATENT DOCUMENTS

| | | | | |
|---|---|---|---|---|
| 5,274,201 | A * | 12/1993 | Steele | A47L 9/0081 181/224 |
| 7,712,576 | B2 * | 5/2010 | Goto | G06F 1/182 181/225 |
| 8,641,494 | B2 * | 2/2014 | Matthews | F24F 13/18 454/262 |
| 9,767,783 | B2 * | 9/2017 | Ishida | G03G 21/1619 |
| 9,904,229 | B2 * | 2/2018 | Matsuda | G03G 15/6552 |
| 10,281,876 | B2 * | 5/2019 | Umenai | G03G 21/20 |
| 10,540,953 | B2 * | 1/2020 | Ishida | G03G 21/1619 |
| 2008/0053749 | A1 * | 3/2008 | Utsunomiya | G03B 21/16 181/286 |

(Continued)

FOREIGN PATENT DOCUMENTS

| | | | | |
|---|---|---|---|---|
| CN | 107204181 | A * | 9/2017 | G10K 11/178 |
| JP | 2000235396 | | 9/2000 | |

(Continued)

*Primary Examiner* — Forrest M Phillips
(74) *Attorney, Agent, or Firm* — JCIPRNET

(57) ABSTRACT

A noise reducing structure includes a first resonance tube that extends in a first direction, that takes in from a sound absorbing opening portion a sound wave that is generated from a noise source, and that causes the sound wave to resonate to reduce leakage to outside; and a second resonance tube that extends in a second direction differing from the first direction, and that, along with the first resonance tube, causes the sound wave that is generated from the noise source to resonate to reduce the leakage to the outside.

7 Claims, 17 Drawing Sheets

(56) References Cited

U.S. PATENT DOCUMENTS

| | | | | |
|---|---|---|---|---|
| 2016/0070230 | A1* | 3/2016 | Kokubu | G03G 21/206 399/92 |
| 2016/0161904 | A1* | 6/2016 | Matsuda | G03G 15/6552 399/91 |
| 2016/0225363 | A1* | 8/2016 | Ishida | G03G 21/1619 |

FOREIGN PATENT DOCUMENTS

| | | | | |
|---|---|---|---|---|
| JP | 2002023598 | | 1/2002 | |
| JP | 2003043861 | | 2/2003 | |
| JP | 2009145740 | * | 7/2009 | |
| JP | 2015169701 | | 9/2015 | |
| WO | WO-2018235797 | A1 * | 12/2018 | G10K 11/172 |

* cited by examiner

NOISE REDUCING STRUCTURE AND IMAGE FORMING APPARATUS

CROSS-REFERENCE TO RELATED APPLICATIONS

This application is based on and claims priority under 35 USC 119 from Japanese Patent Application No. 2017-187528 filed Sep. 28, 2017.

BACKGROUND

Technical Field

The present invention relates to a noise reducing structure and an image forming apparatus.

SUMMARY

According to an aspect of the invention, there is provided a noise reducing structure including a first resonance tube that extends in a first direction, that takes in from a sound absorbing opening portion a sound wave that is generated from a noise source, and that causes the sound wave to resonate to reduce leakage to outside; and a second resonance tube that extends in a second direction differing from the first direction, and that, along with the first resonance tube, causes the sound wave that is generated from the noise source to resonate to reduce the leakage to the outside.

BRIEF DESCRIPTION OF THE DRAWINGS

Exemplary embodiments of the present invention will be described in detail based on the following figures, wherein.

DETAILED DESCRIPTION

Exemplary embodiments of the present invention are described below with reference to the drawings.

First Exemplary Embodiment

Figure 1:
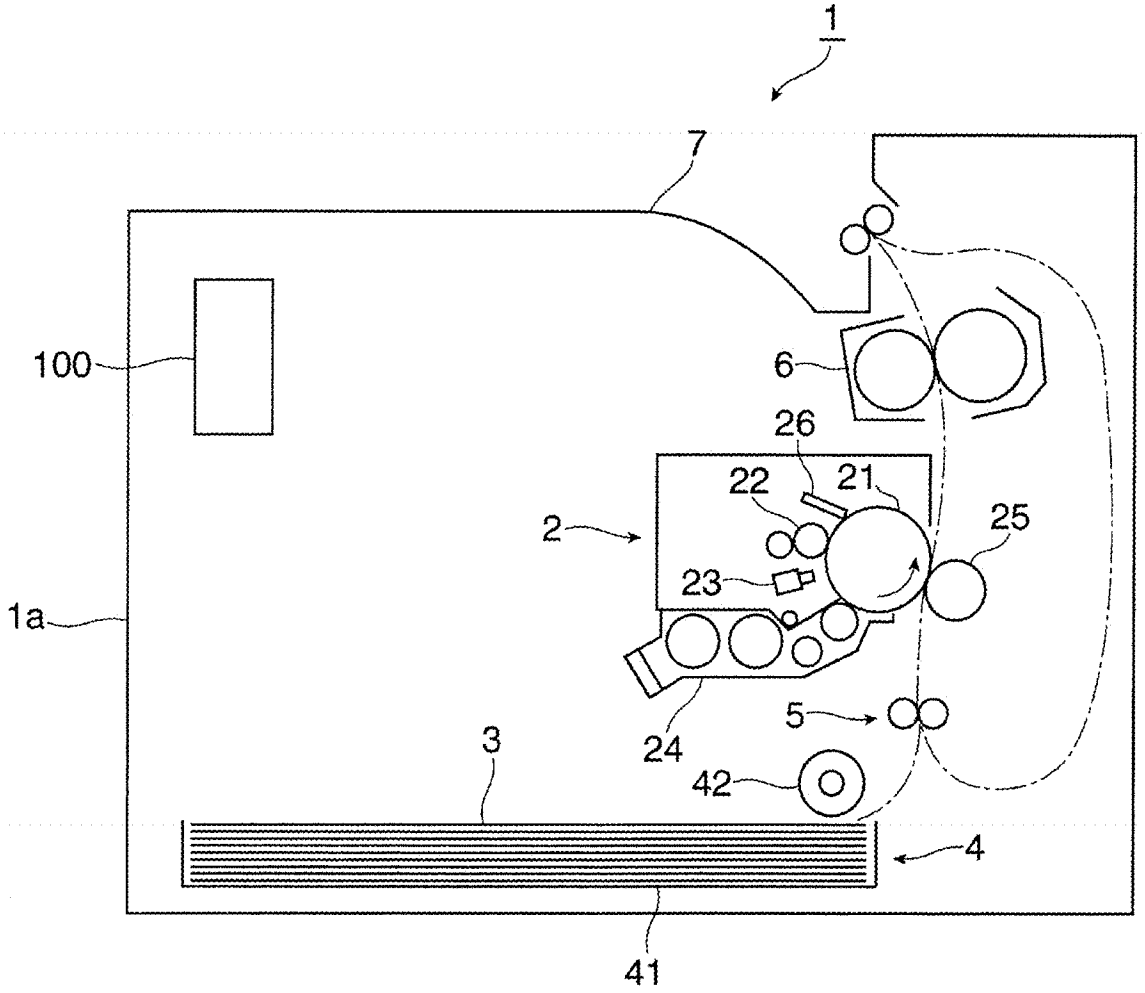
FIG. 1 is a schematic view of a structure of an image forming apparatus to which a noise reducing structure according to a first exemplary embodiment of the present invention is applied.

FIG. 1 is a schematic view of a structure of an entire image forming apparatus 1 to which a noise reducing structure according to a first exemplary embodiment is applied.

Structure of Entire Image Forming Apparatus

The image forming apparatus 1 according to the first exemplary embodiment is, for example, a monochrome printer. The image forming apparatus 1 includes, for example, an image forming unit 2 that forms a toner image (image) formed by performing development with toner of developer; a sheet-feeding unit 4 that supplies recording paper 3, serving as an exemplary recording medium, to the image forming unit 2; a transporting unit 5 that transports to, for example, the image forming unit 2 pieces of recording paper 3 that are supplied one at a time from the sheet-feeding unit 4; and a fixing unit 6 that performs fixing on the recording paper 3 on which the toner image has been formed by the image forming unit 2.

The image forming unit 2 forms an image on a surface of recording paper 3 by performing an electrophotographic process that uses developer. The image forming unit 2 includes, for example, a photoconductor drum 21, serving as an exemplary image carrier; a charging device 22 that charges a peripheral surface of the photoconductor drum 21; an exposure device 23 that exposes the photoconductor drum 21 to light and forms an electrostatic latent image; a developing device 24 that supplies developer to the electrostatic latent image on the photoconductor drum 21 and develops the electrostatic latent image; a transfer device 25 that transfers the toner image formed on the photoconductor drum 21 to the recording paper 3; and a cleaning device 26 that cleans the peripheral surface of the photoconductor drum 21. The transfer device 25 may be one that does not directly transfer the toner image to the recording paper 3 from the photoconductor drum 21. That is, the transfer device 25 may be one that transfers the toner image to the recording paper 3 via an intermediate transfer body, such as an intermediate transfer belt. The developer may contain, for example, black toner. The developer may contain, in addition to black toner, color toners, such as yellow toner, magenta toner, and cyan toner.

The sheet-feeding unit 4 includes, for example, a holding container 41 that holds recording paper 3 and a sheet-feeding roller 42 that feeds pieces of the recording paper 3 one at a time from the holding container 41. By setting the holding container 41 at an apparatus body 1*a* of the image forming apparatus 1, the sheet-feeding unit 4 is capable of supplying the pieces of recording paper 3 held in the holding container 41. The holding container 41 is mounted such that, for example, the holding container 41 is capable of being drawn out towards the front of the apparatus body 1*a* (towards a side surface that a user faces when the user operates the image forming apparatus 1), that is, towards a side of a left side surface in the illustrated example.

The transporting unit 5 transports recording paper 3 that is fed from the sheet-feeding unit 4 to the image forming unit 2 and the fixing unit 6 to discharge the recording paper 3 on which the image has been formed to a discharging section 7 that is disposed at a top portion of the apparatus body 1*a*. When images are to be formed on both surfaces of the recording paper 3, the transporting unit 5 re-transports the recording paper 3 on which the image has been formed on one surface thereof to the image forming unit 2 with the front and back surfaces of this recording paper 3 being reversed without discharging this recording paper 3 to the discharging section 7.

The fixing unit 6 fuses the toner image, formed on the surface of the recording paper 3 by the image forming unit 2, by using heat and pressure, and fixes the toner image to the recording paper 3. The recording paper 3 to which the image has been fixed by the fixing unit 6 is discharged to and is held by the discharging section 7 with the recording paper 3 placed thereon.

In FIG. 1, reference numeral 100 denotes a controlling device that performs overall control on the operation of the image forming apparatus 1.

Structure of Apparatus Body of Image Forming Apparatus

Figure 2A:
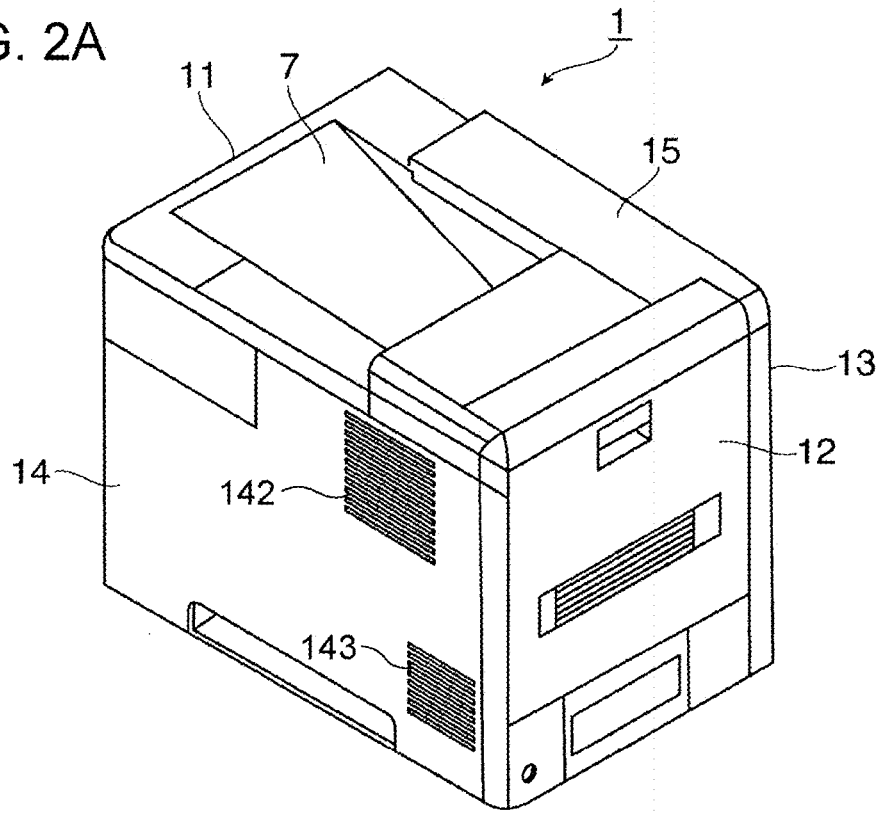
FIGS. 2A and 2B each are a perspective view of a structure of an apparatus body of the image forming apparatus according to the first exemplary embodiment of the present invention.

As illustrated in FIG. 2A, the apparatus body 1*a* of the image forming apparatus 1 is formed as a box body whose external shape is a substantially rectangular-parallelepiped shape. The apparatus body 1*a* includes a front cover 11, a rear cover 12, left and right side covers 13 and 14, and an upper cover 15. The front cover 11 is an example of an exterior body that covers a front surface (a left side surface in FIG. 2A) of the apparatus body 1*a*. The rear cover 12 is an example of an exterior body that covers a rear surface of the apparatus body 1*a*. The left and right side covers 13 and 14 are examples of exterior bodies that cover left and right side surfaces of the apparatus body 1*a*, corresponding thereto. The upper cover 15 is an example of an exterior body that covers an upper portion of the apparatus body 1*a*. Of these covers, for example, the rear cover 12 and the right side cover 14 are provided so as to be openable and closable as appropriate.

Figure 2B:
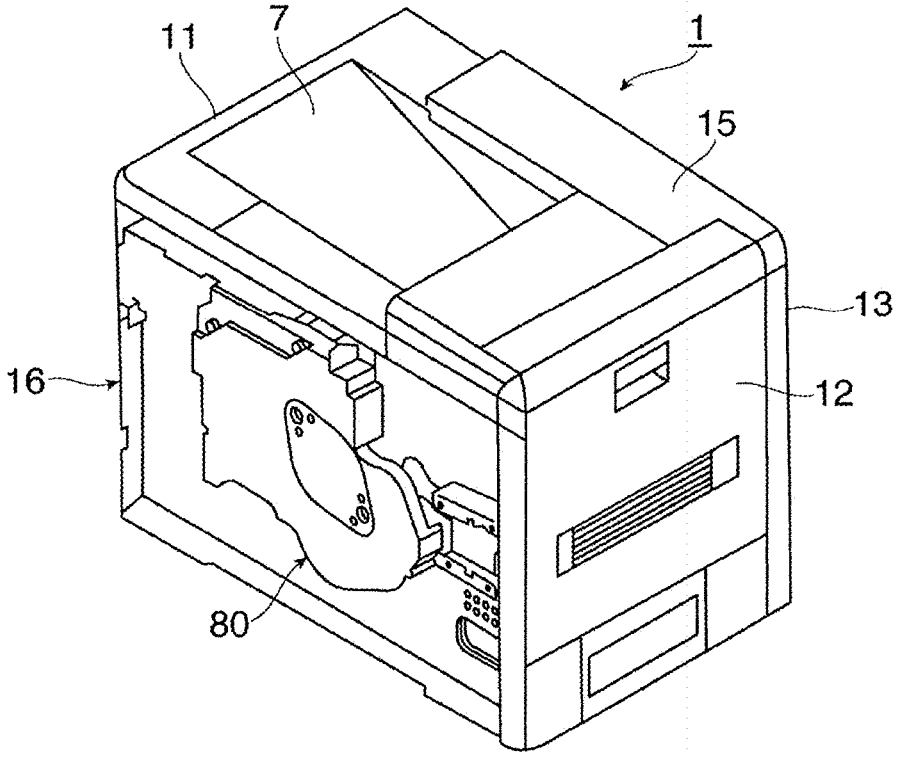

As illustrated in FIG. 2B in which the right side cover 14 is removed, the apparatus body 1*a* includes a frame structural member serving as an exemplary internal structural body that is covered by the exterior bodies. The frame structural member includes, for example, left and right side frames 16 (the left side frame is not illustrated) and a connecting frame (not illustrated). The left and right side frames 16 are disposed on the left and right side surfaces of the apparatus body 1*a* corresponding thereto. The connecting frame connects the left and right side frames 16 on a forward surface side and on a rear surface side of the apparatus body 1*a* corresponding thereto.

Figure 11:
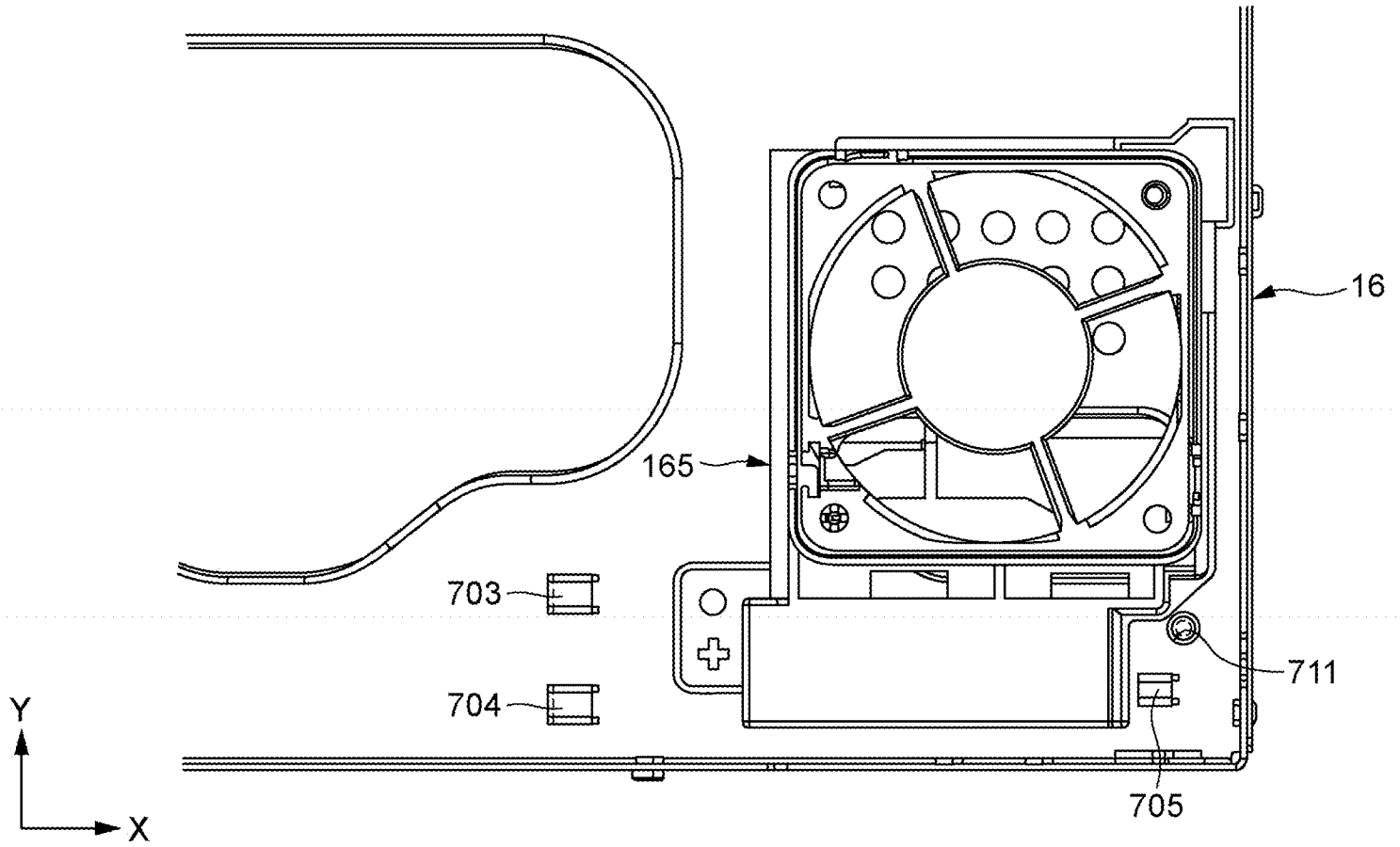
FIG. 11 is a front view of a structure of a portion of the right side frame.

Various members that constitute, for example, the image forming unit 2, the sheet-feeding unit 4, the transporting unit 5, and the fixing unit 6 are mounted on the left and right side frames 16. A driving device 80 that drives, for example, the image forming unit 2, the sheet-feeding unit 4, and the transporting unit 5 is mounted on the right side frame 16. Furthermore, as illustrated in FIG. 11, an exhaust fan 165 and an intake fan (not illustrated) are attached to the right side frame 16. The exhaust fan 165 serves as an exemplary air sending unit that discharges the air in the apparatus body 1*a* to the outside. The intake fan (not illustrated) serves as an exemplary air sending unit that introduces the outside air into the apparatus body 1*a*. In FIG. 2A, reference sign 142 denotes a louver corresponding to the intake fan (not illustrated), and reference sign 143 denotes a louver corresponding to the exhaust fan 165.

Figure 3:
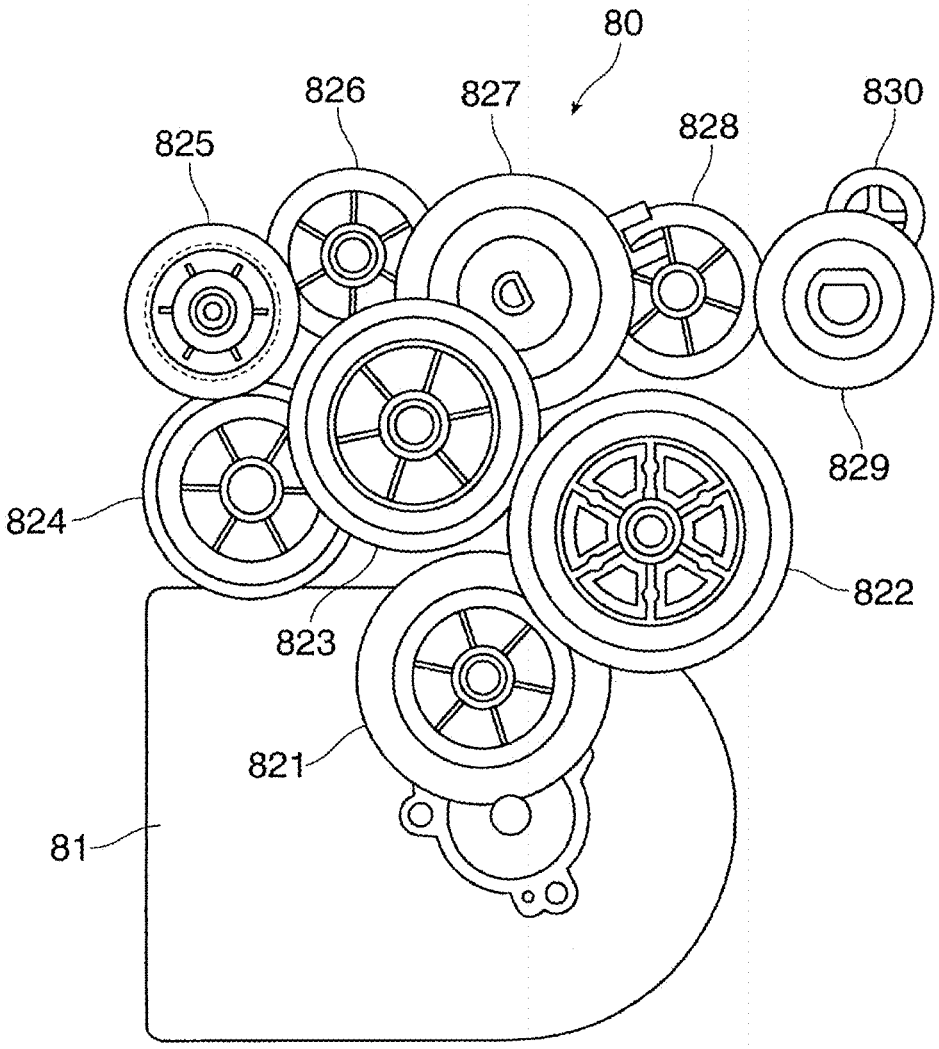
FIG. 3 illustrates a structure of a driving device.

As illustrated in FIG. 3, the driving device 80 includes, for example, a driving motor 81 and multiple driving force transmission gears 821 to 830. The driving motor 81 serves as a driving source. The multiple driving force transmission gears 821 to 830 transmit driving force of the driving motor 81 to rotary bodies, such as the photoconductor drum 21 and the developing device 24 of the image forming unit 2, the sheet-feeding unit 4, the transporting unit 5, and the fixing unit 6.

Figure 4:
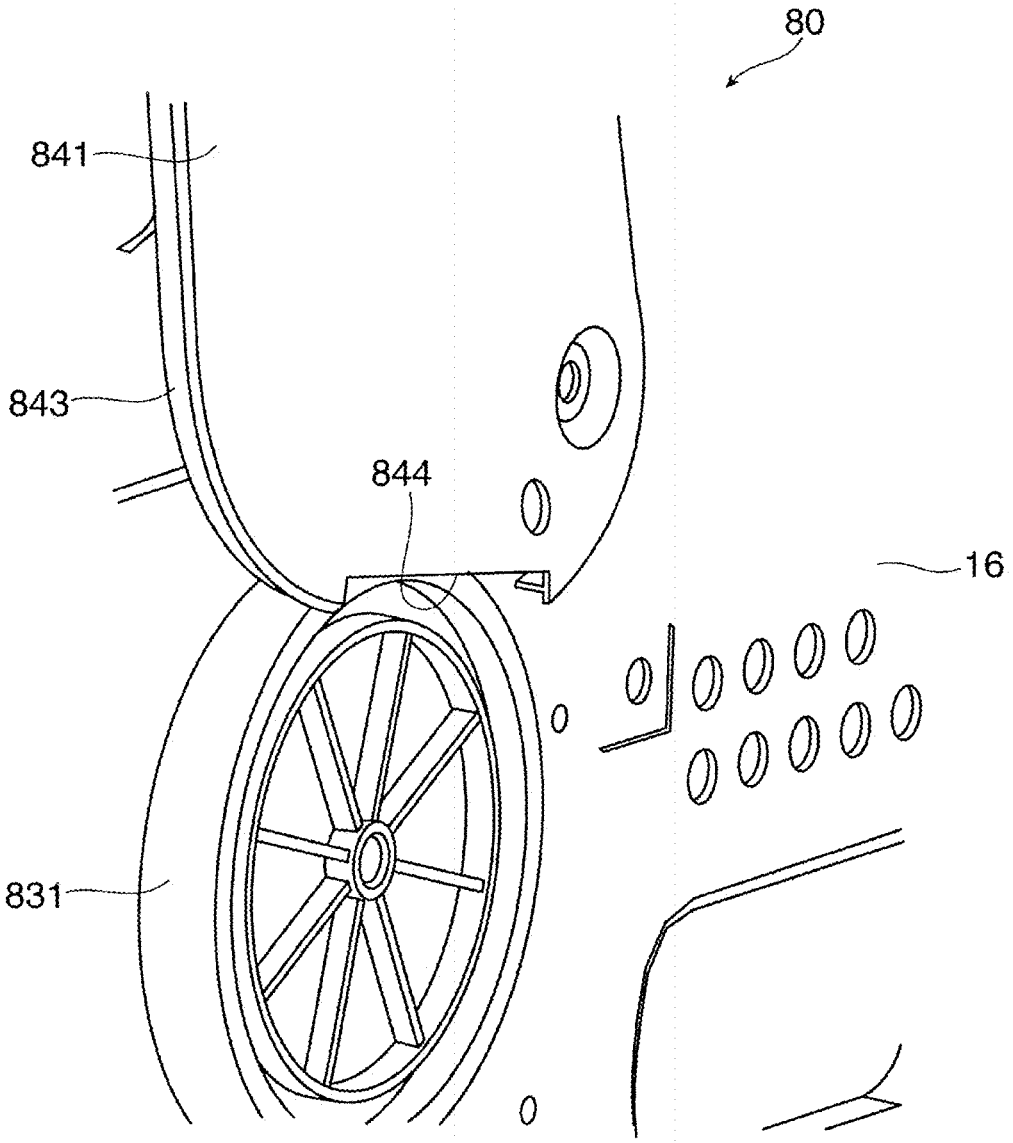
FIG. 4 is a perspective view of the structure of the driving device.

As illustrated in FIG. 1, as rotary bodies that are rotationally driven by the driving device 80, there exist rotary bodies having, for example, various outside diameters, made of various materials, and having various weights, such as the photoconductor drum 21, a developing roller and stirring-and-transporting member of the developing device 24, the sheet-feeding roller 42 of the sheet-feeding unit 4, transporting rollers of the transporting unit 5, and a heating roller of the fixing unit 6. Of these rotary bodies, the rotary body having the largest outside diameter and weight is the photoconductor drum 21. When the speed (the peripheral speed) of each rotary body that is determined on the basis of a process speed of the image forming apparatus 1 is fixed, the rotation speed of the photoconductor drum 21 having the largest outside diameter is the lowest. Therefore, of the driving force transmission gears that transmit rotational driving force of the driving motor 81, as illustrated in FIG. 4, the outside diameter of a driving force transmission gear 831 that transmits the rotational driving force to the photoconductor drum 21 is the largest. As a result, the frequency of a driving sound that is generated from, for example, the driving force transmission gear 831 that transmits the rotational driving force to the photoconductor drum 21 becomes the lowest, so that the driving sound becomes a sound having a relatively low frequency of 1000 Hz (1 KHz) or less.

Figure 5:
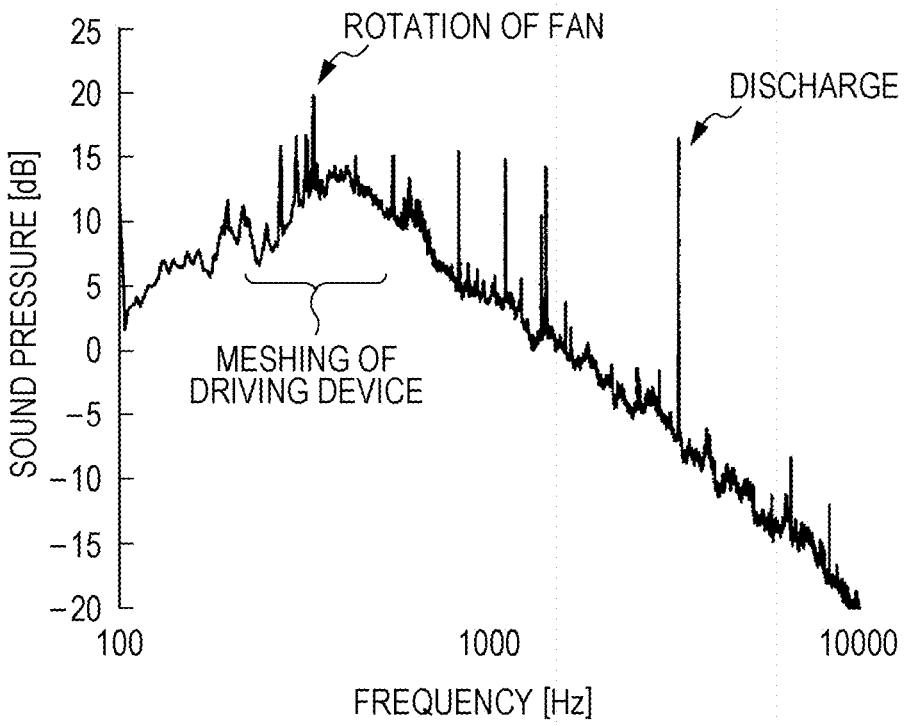
FIG. 5 is a graph showing a frequency distribution of noises that are generated by the image forming apparatus.

When performing an image forming operation, the image forming apparatus 1 generates a driving sound due to the driving device 80 rotationally driving, for example, the image forming unit 2, the sheet-feeding unit 4, the transporting unit 5, and the fixing unit 6. In addition, as illustrated in FIG. 5, the image forming apparatus 1 generates, for example, an electrostatic discharge sound or a mechanical sliding friction sound that is generated when each step, such as a charging step on the surface of the photoconductor drum 21, a developing step, a transfer step, a sheet-feeding step, and a transporting step, is performed; and rotation sounds of the exhaust fan 165 and the intake fan are generated. For example, various driving sounds, discharge sounds, sliding friction sounds, and rotation sounds that are generated by the image forming apparatus 1 leak to the outside of the apparatus body 1*a* and become noises. Among the various noises that are generated by the image forming apparatus 1, the principal noise is a mechanical driving sound that is generated by the driving device 80 and a rotation sound of the exhaust fan 165. Of mechanical driving sounds that are generated by the driving device 80, in particular, a sound having a relatively low frequency of 1000 Hz (1 KHz) or less is difficult to attenuate sufficiently at, for example, the front cover 11, the rear cover 12, the side covers 13 and 14, and the upper cover 15, which have required thicknesses and are made of synthetic resin or the like (refer to paragraph [0012] of Japanese Unexamined Patent Application Publication No. 2000-235396).

In Japanese Unexamined Patent Application Publication No. 2000-235396, a resonance space corresponding to the frequency that is generated during operation is formed between an exterior member and an interior member. The resonance space in Japanese Unexamined Patent Application Publication No. 2000-235396 constitutes a Helmholtz resonator as described in the detailed description of the invention. As is publicly known, a Helmholtz resonator is a device in which the air existing in a container having an open portion acts as a spring and resonates, and has a silencing effect of attenuating sound due to resonating air vibration passing through the open portion.

However, a Helmholtz resonator has technical problems in that since the air existing in the container acts as a spring, the device tends to be large; and in that since the attenuating effect is produced by using the open portion, the silencing effect is not easily sufficiently produced. In particular, when a Helmholtz resonator is used to absorb a sound having a low frequency, the size of the device is increased.

Regarding such technical problems, paragraph [0007] in Japanese Unexamined Patent Application Publication No. 2015-169701 that provides an electrical device including a Helmholtz arrester states that "However, in the case described in PTL 2, the noise reducing effect that is actually obtained is less than the expected noise reducing effect." Incidentally, PTL 2 that is discussed in paragraph [0007] in Japanese Unexamined Patent Application Publication No. 2015-169701 refers to Japanese Unexamined Patent Application Publication No. 2003-43861 in which a Helmholtz resonator is similarly used.

In the exemplary embodiment, attention is paid to a function as a resonance tube that generates a standing wave of a sound of a particular frequency in a space formed with a tubular shape or the like, instead of to a Helmholtz resonator in which the air existing in a container having an open portion acts as a spring. Moreover, this is based on a new technical idea that, instead of forming a resonance tube as a structural body extending simply straight, forms a resonance tube that is disposed two-dimensionally or three-dimensionally.

Figure 6:
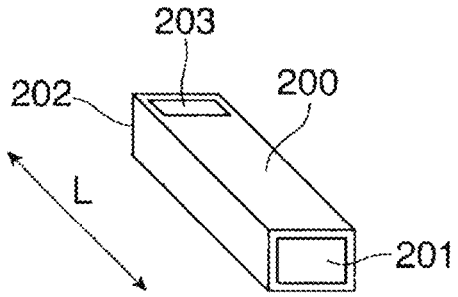
FIG. 6 illustrates the principles of a resonance tube.

FIG. 6 schematically illustrates the basic principles of a resonance tube.

When sound is incident upon a tube 200 (hereunder referred to as "resonance tube") having one end 201 open and the other end 202 closed from a sound absorbing opening portion 203 open at the other end 202, resonance occurs at a frequency dependent upon a length L of the resonance tube 200. Therefore, by setting the length L of the resonance tube 200 as appropriate, it is possible to cause a sound having a target frequency to resonate to reduce leakage to outside. In addition, when a sound absorbing material or a sound absorbing mechanism is provided in the resonance tube 200 (an antinode of particle speed or an antinode of sound pressure), it is possible to increase a noise reducing effect of reducing the incident sound. The one end 201 may be closed, in which case the sound pressure distribution of the one end 201 becomes a node. In general, when the one end 201 is closed, the length L of the resonance tube 200 may be $L=\lambda/4$, which is shorter than the length $L=\lambda/2$ of the resonance tube 200 when the one end 201 is open.

In the resonance tube 200 that causes noise to resonate, the wavelength $\lambda$ of sound is increased when the sound is a low-frequency sound whose frequency is relatively low, and hence it is required to set the length L of the resonance tube 200 at a large value.

However, in the image forming apparatus 1, it may be difficult to ensure the length L of the resonance tube 200 corresponding to a target low-frequency sound at a relatively low frequency only in one direction, due to reduction in size of the apparatus body 1*a* and the layout of various members.

Owing to this, in the exemplary embodiment, to form a resonance tube corresponding to a low-frequency sound at a relatively low frequency even if it is difficult to form the resonance tube 200 only in one direction due to limitation on size, there are provided a first resonance tube that extends in a first direction, that takes in from a sound absorbing opening portion a sound wave that is generated from a noise source, and that causes the sound wave to resonate to reduce leakage to outside, and a second resonance tube that extends in a second direction differing from the first direction, and that, along with the first resonance tube, causes the sound wave that is generated from the noise source to resonate to reduce the leakage to the outside. Also, in the exemplary embodiment, there is provided a third resonance tube that extends in a third direction differing from the first and second directions, and that, along with the first and second resonance tubes, causes the sound wave that is generated from the noise source to resonate to reduce the leakage to the outside.

Figure 7:
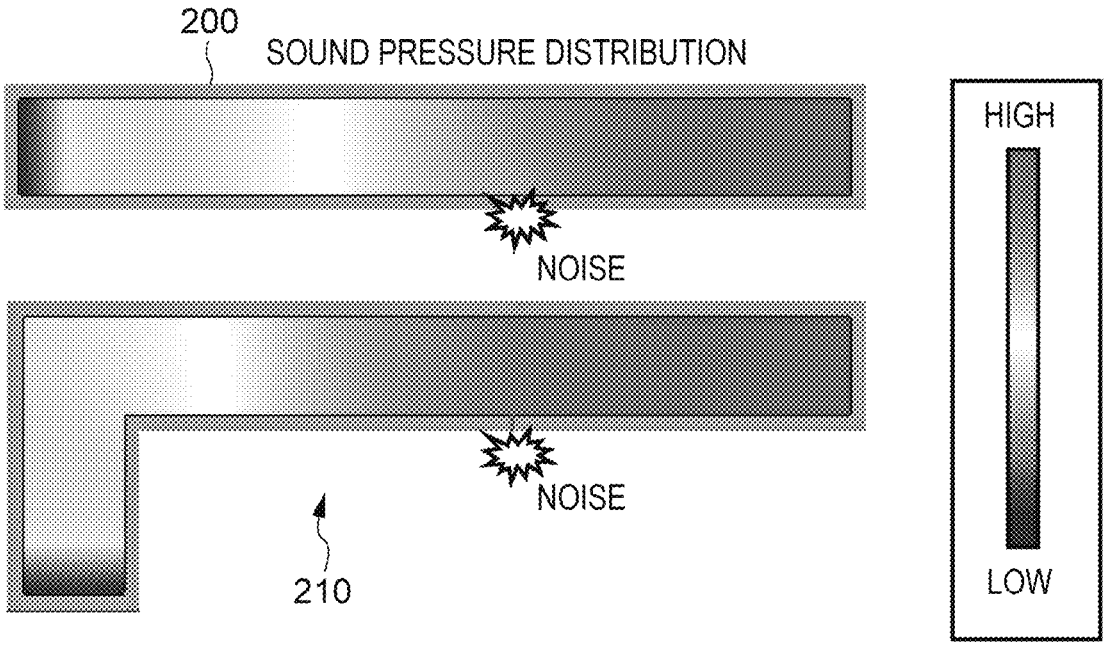
FIG. 7 is a schematic view illustrating a sound pressure distribution of a two-dimensional resonance tube.
Figure 8A:
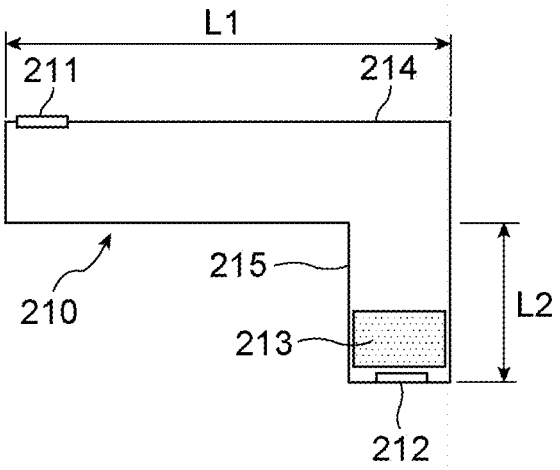
FIGS. 8A and 8B illustrate a structure of the two-dimensional resonance tube.
Figure 8B:
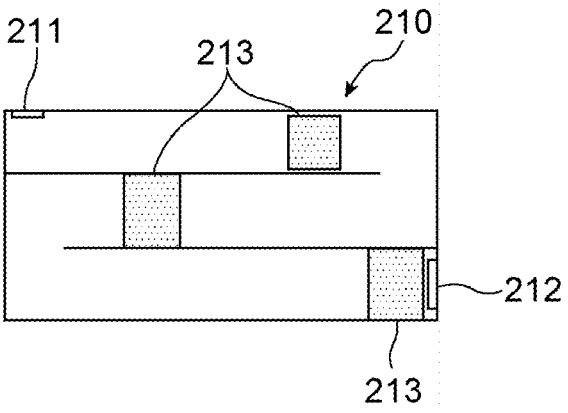
Figure 9:
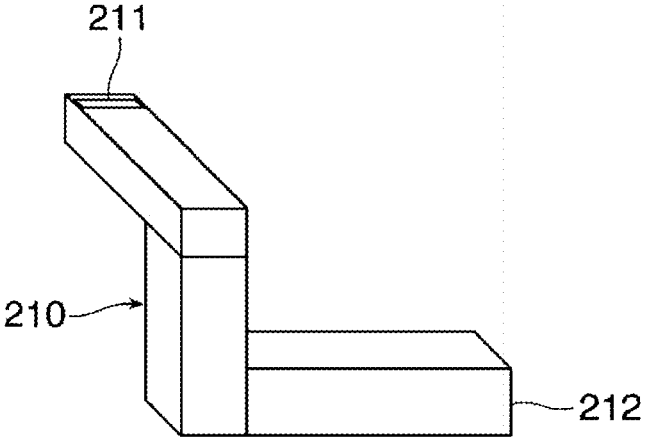
FIG. 9 illustrates a structure of a three-dimensional resonance tube.

FIG. 7 schematically illustrates a distribution of sound pressures, with gradation, in a resonance tube 210 that is formed two-dimensionally. FIGS. 8A and 8B schematically illustrate an internal structure of the resonance tube 210 that is formed two-dimensionally. FIG. 9 schematically illustrates a resonance tube 210 that is formed three-dimensionally.

A resonance tube 210 is formed with a tube shape having a rectangular cross-section and bent in an L shape or a substantial L shape. The cross-sectional shape of the resonance tube 210 is not limited to the rectangular shape, and may be a circular shape. The resonance tube 210 has a sound absorbing opening portion 211 in a surface of one end portion closed in a longitudinal direction of the resonance tube 210. Also, the resonance tube 210 has an opening 212 at an end portion opposite to the air absorbing opening portion 211 in the longitudinal direction. Also, a sound absorbing material 213 is disposed at a position corresponding to an antinode of the particle speed if required. The end portion opposite to the sound absorbing opening portion 211 may be closed.

In the exemplary embodiment illustrated in FIG. 8A, the resonance tube 210 includes a first resonance tube 214 having a length L1 and a second resonance tube 215 having a length L2. When the resonance tube 200 illustrated in FIG. 7 functions as a resonance tube that causes a sound of a frequency of 500 Hz to resonate, since sound wavelength=sound speed/frequency, if the length L is set at $\lambda/4$, the length L of the resonance tube 200 is about 17 cm. In the case of an open tube in which one end of the resonance tube 200 is open, the length L is set at $\lambda/2$. In contrast, in the case of the resonance tube 210 illustrated in FIG. 8A, the lengths of the first resonance tube 214 and the second resonance tube 215 may be, for example, 10 cm and 7 cm, and the total length L1+L2 may be about 17 cm. In the case of an open end in which one end of the resonance tube 210 is open, regarding an antinode present at an end portion of the resonance tube 210, the end portion in which sound resonates more than resonance of sound in a tube is actually located at a slightly outer side with respect to the tube, and it is required to perform fine adjustment by an amount corresponding to an open-end-portion correction value+ΔL (in the case of open tube, +2ΔL). ΔL is at the outer side by 0.6 in a case of a cylindrical tube with a radius a. The total length of the resonance tube 210 (=L1+L2) is not limited to λ/4 of the wavelength λ of the sound, and of course may be set at λ/2, 1λ, 2λ, . . . . Also, the open tube and the closed tube have different intervals.

Figure 19:
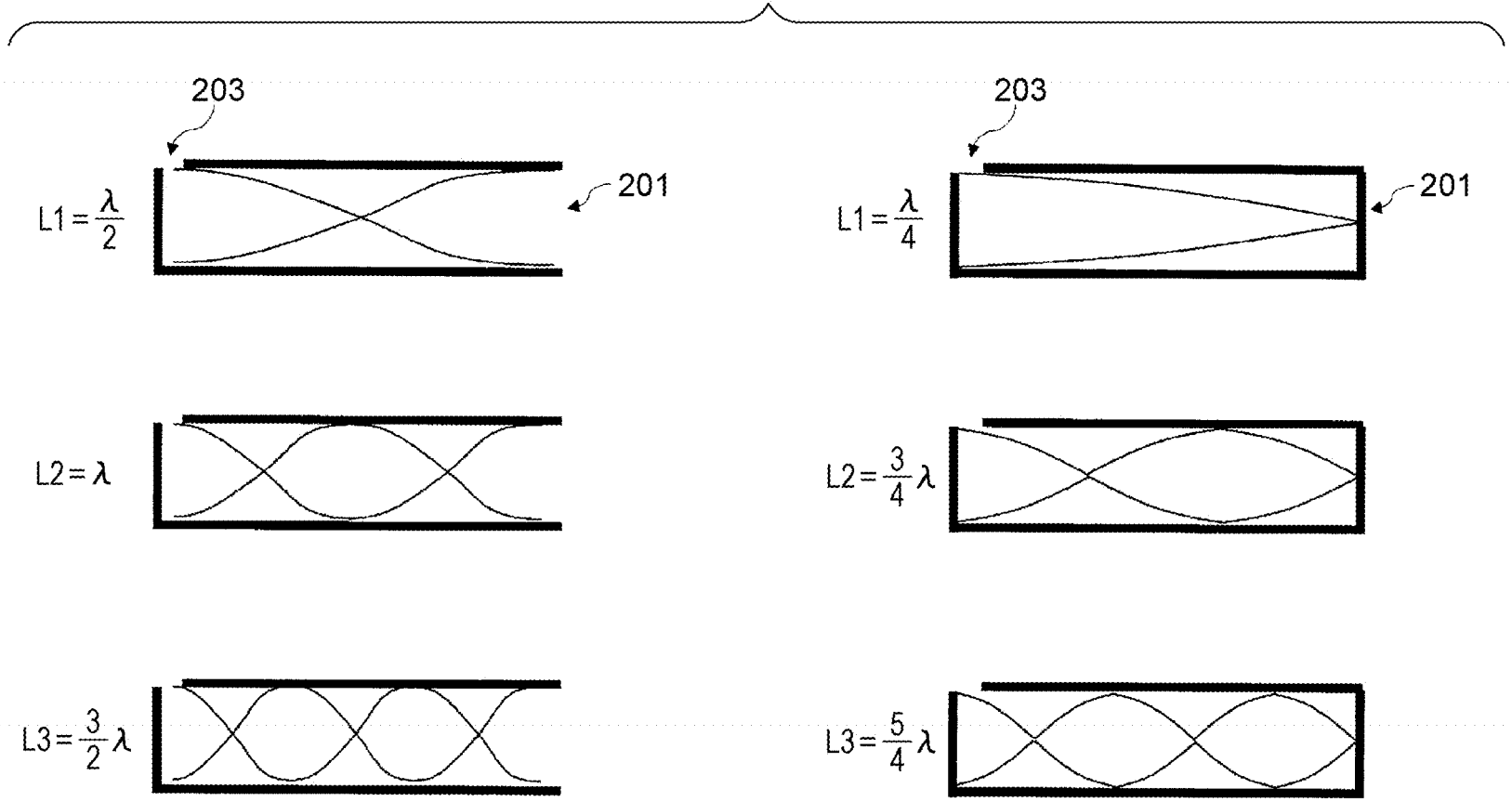
FIG. 19 provides explanatory views each showing a relationship between the length of a resonance tube and the wavelength of a sound wave.

When the relationship between the resonance wavelength, at which the first to third resonance tubes 721 to 723 make resonance, and the length of the tube is formulated, the formula is as follows as illustrated in FIG. 19.

Open tube $\lambda_n=2L/n$ ($n$=1, 2, . . . )

Closed tube $\lambda_n=4L/(2n-1)$ (λ: wavelength (=sound speed/frequency))

These are rewritten according to the lengths of the first to third resonance tubes 721 to 723 as follows.

Open tube $L=(\lambda/2)n$

Closed tube $L=(\lambda/4)\ (2n-1)$

Figure 10:
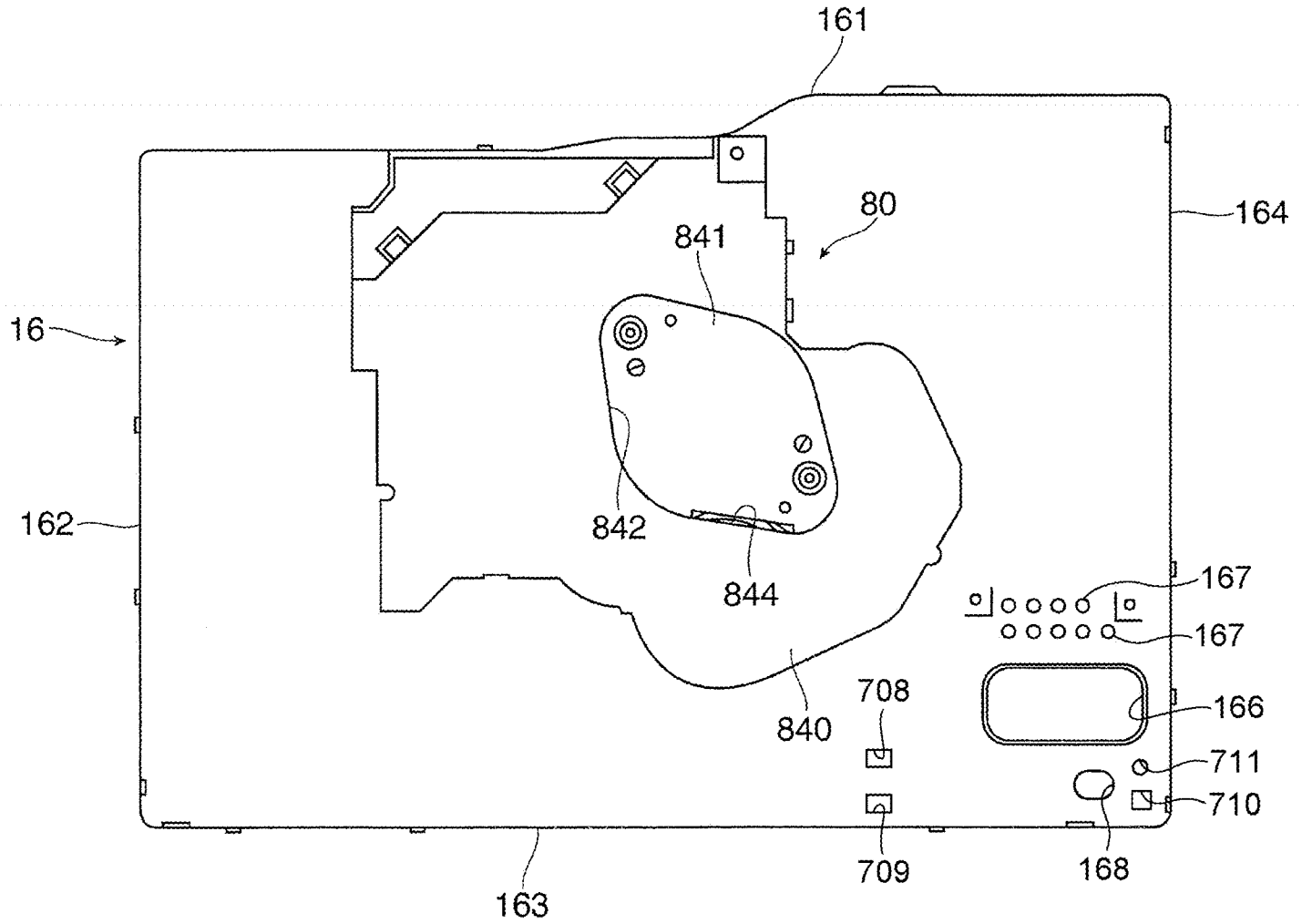
FIG. 10 is a front view of a structure of a right side frame.

The exemplary embodiment is further specifically described. As illustrated in FIGS. 10 and 11, the exhaust fan 165 is attached to an outer side surface of the right side frame 16 by screwing or the like, at a lower end portion of the right side frame 16 on a rear surface side. The right side frame 16 has an exhaust opening 166 having a substantially rectangular shape at a position corresponding to the exhaust fan 165, and plural exhaust holes 167 being open above the opening 166. The right side frame 16 also has a datum hole 168 being thin and long and serving as a reference when the right side frame 16 is handled, for example, when the right side frame 16 is assembled, at a position below the opening 166 on the rear surface side.

As illustrated in FIG. 10, the right side frame 16 is formed with rectangular side surfaces by, for example, press working or welding a metal sheet. The right side frame 16 is formed with a high rigidity by forming it with the shape of a frame body as a result of outwardly bending outer peripheral edges 161 to 164 thereof. A housing (bracket) 840 of the driving device 80 that is made from, for example, a metal sheet or synthetic resin is mounted on an outer side surface of the right side frame 16 in a fixed state. The driving force transmission gears 821 to 830 and 831 of the driving device 80 and multiple rotatory shafts (not illustrated) that support the driving force transmission gears 821 to 830 and 831 are disposed in the housing 840 of the driving device 80 perpendicularly to a surface of the right side frame 16.

At a central portion of the housing 840 of the driving device 80, a drum supporting cover (bracket) 841 is mounted on the right side frame 16 by, for example, screwing. The drum supporting cover 841 is formed with a substantially rhombic shape by using, for example, a metal sheet; and rotatably supports an end portion of the photoconductor drum 21 in an axial direction via a bearing member (not illustrated). An open portion 842 corresponding to the shape of the drum supporting cover 841 is provided in a region of the right side frame 16 corresponding to the drum supporting cover 841. As illustrated in FIG. 4, a flange portion 843 is formed on an outer peripheral end edge of the drum supporting cover 841 by, for example, burring. The driving force transmission gear 831 for rotationally driving the photoconductor drum 21 is rotatably disposed at a lower portion of the drum supporting cover 841. An opening 844 is disposed at a lower end portion of the drum supporting cover 841, for avoiding interference between the driving force transmission gear 831 and the flange portion 843. A surface of the housing 840 and a surface of the drum supporting cover 841 of the driving device 80 form substantially the same plane.

Figure 12:
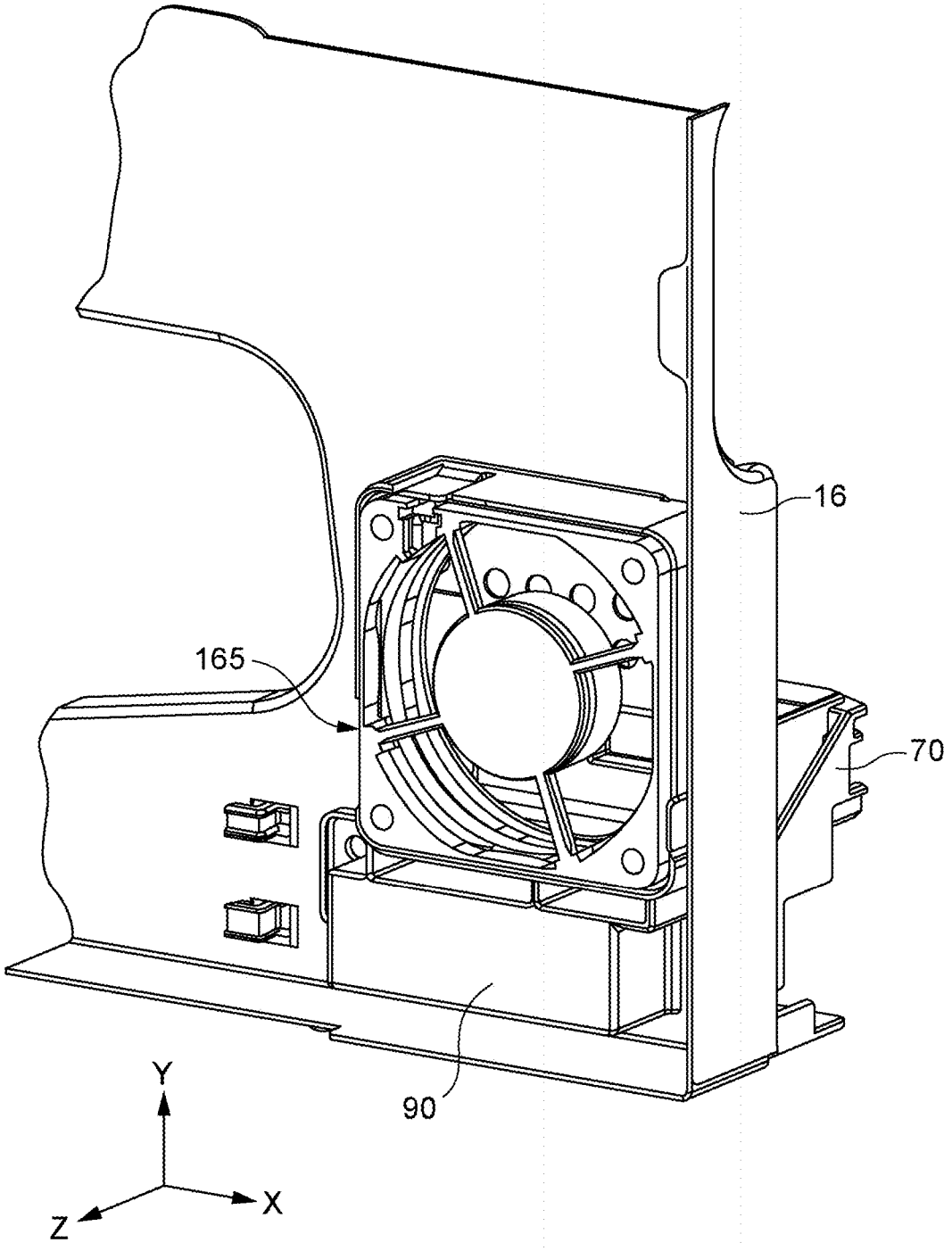
FIG. 12 is a perspective view of the structure of the portion of the right side frame.
Figure 13:
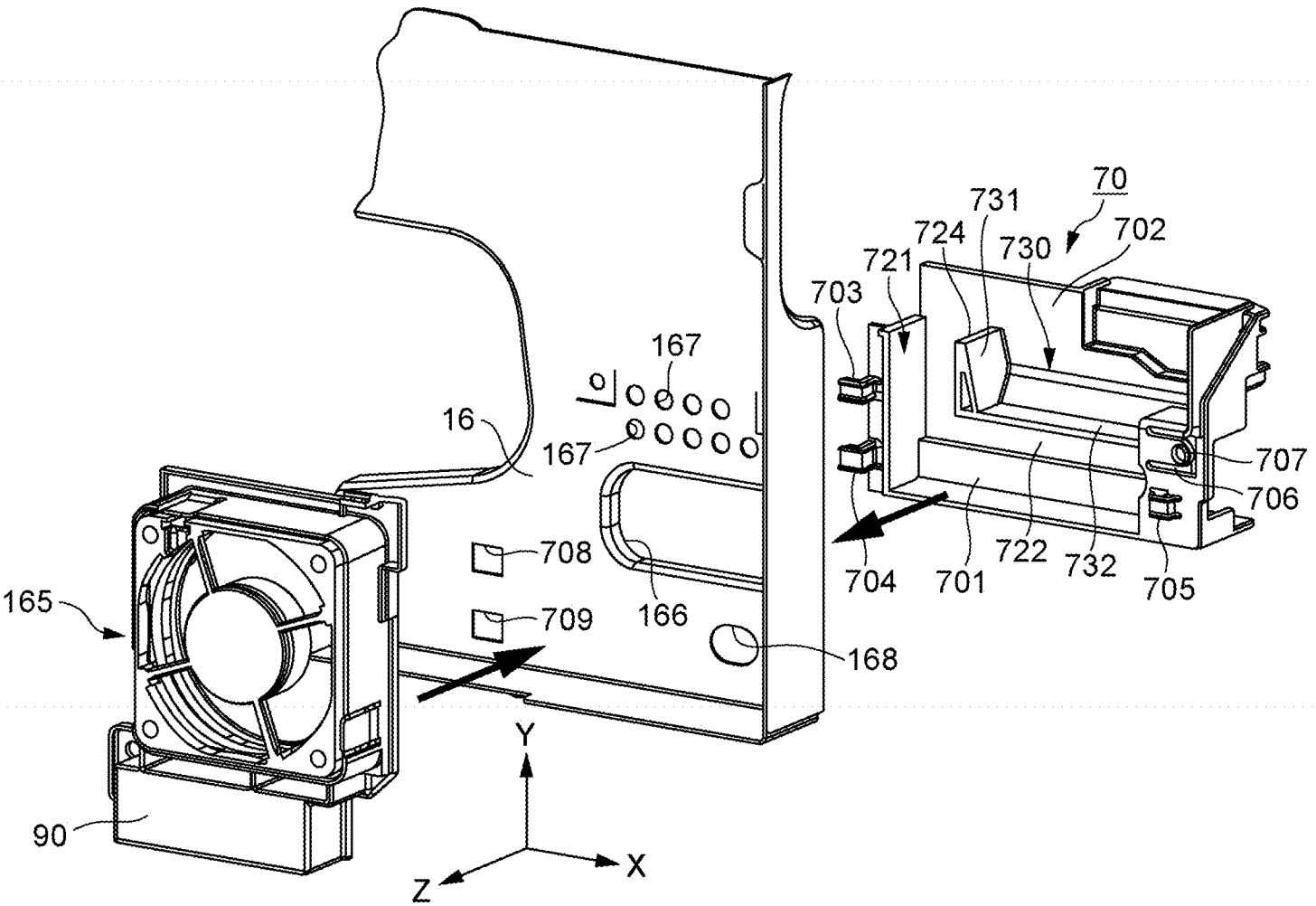
FIG. 13 is an exploded perspective view of the structure of the portion of the right side frame.
Figure 14:
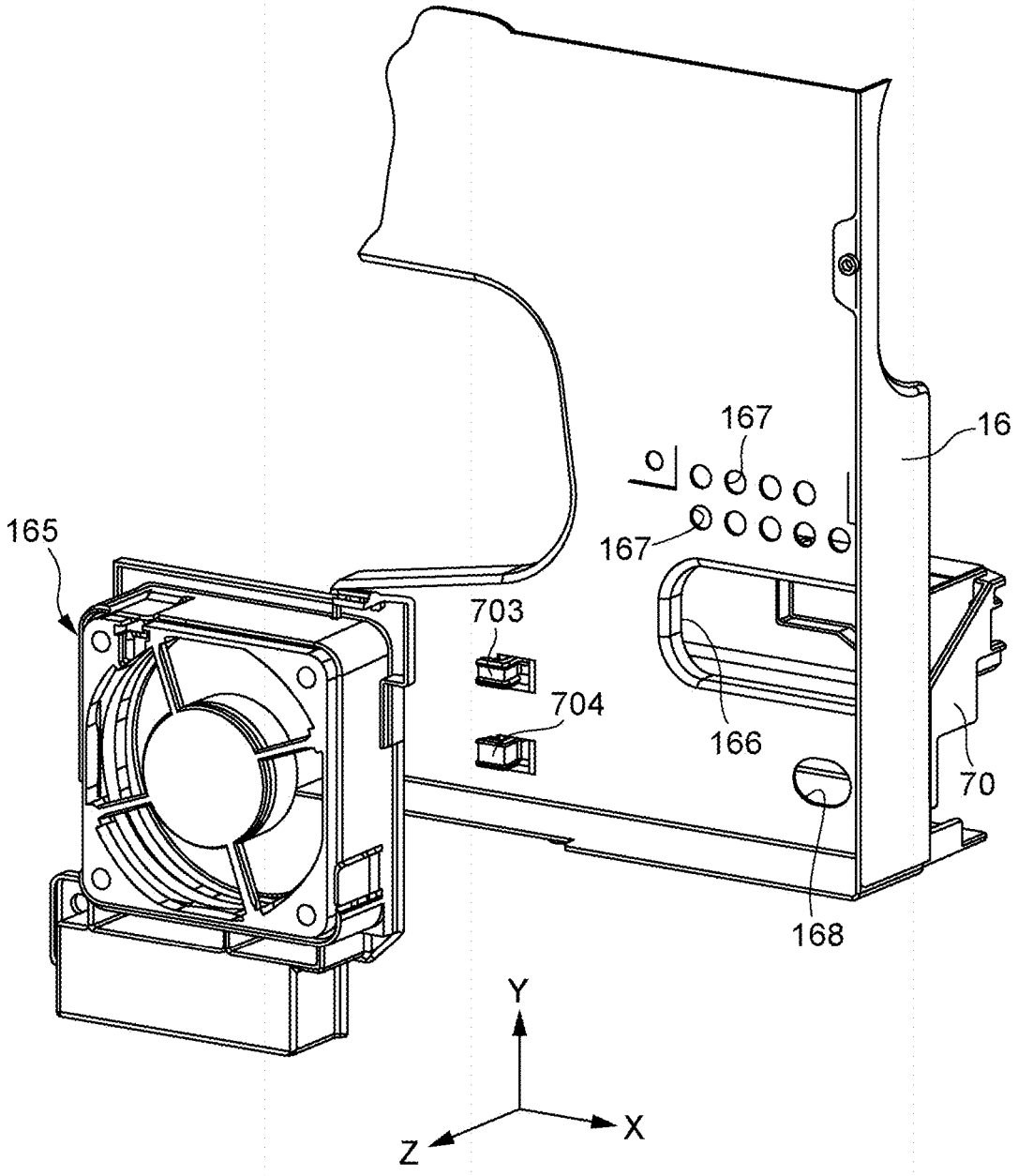
FIG. 14 is an exploded perspective view of the structure of the portion of the right side frame.

As illustrated in FIGS. 12 to 14, a first duct member 70 made of synthetic resin is attached to the right side frame 16. The first duct member 70 constitutes a portion of a guide portion that guides the holding container 41 of the sheet-feeding unit 4 when the holding container 41 is inserted to or removed from an inner side surface of the right side frame 16 at a position corresponding to the exhaust fan 165. The first duct member 70 also constitutes an exhaust duct. As illustrated in FIG. 13, the first duct member 70 is formed with a box body whose side surfaces have a substantially rectangular shape by subjecting, for example, synthetic resin to injection molding, and which has a relatively small depth. The first duct member 70 has a side surface 701 and an upper end portion 702 on the right side frame 16 side. The side surface 701 and the upper end portion 702 are open. An end surface of the first duct member 70 on the right side frame 16 side is provided with three engagement protrusions 703 to 705 having substantially L-shaped cross-sectional shapes, and a snap-fit portion 706. The engagement protrusions 703 to 705 cause the first duct member 70 to be hermetically attached to the right side frame 16, and form a space between the first duct member 70 and the right side frame 16 so that only an upper end portion of the space is partially open. The snap-fit portion 706 positions and fixes the first duct member 70 to the right side frame 16. The snap-fit portion 706 has a base end portion that is connected to a side surface of the first duct member 70 in an elastically deformable manner. Also, a protrusion 707 protruding toward the right side frame 16 is formed at a tip end of the snap-fit portion 706. The first duct member 70 is positioned and fixed by engaging the three engagement protrusions 703 to 705 with engagement hole portions 708 to 710 of the right side frame 16 (see FIGS. 10 and 11), and engaging the protrusion 707 of the snap-fit portion 706 with an engagement hole portion 711 of the right side frame 16.

Figure 15:
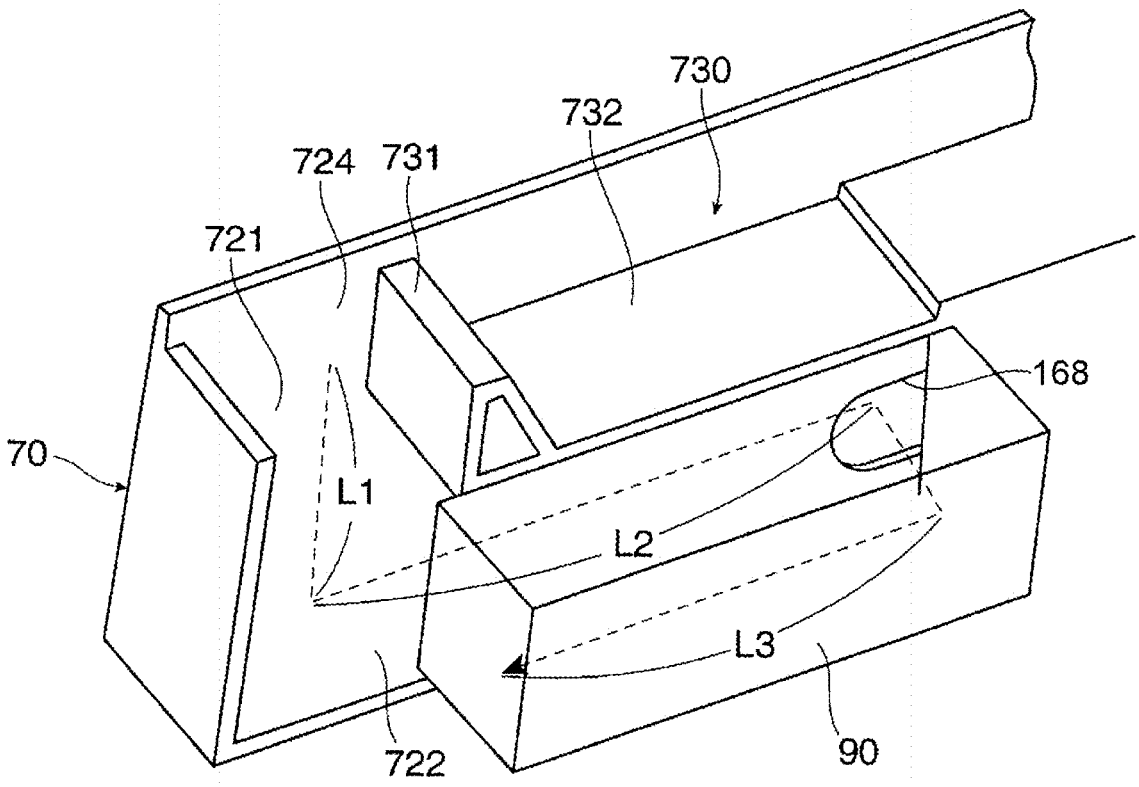
FIG. 15 is a schematic view of a resonance tube.

As illustrated in FIG. 15, the first duct member 70 includes a first resonance tube 721 and a second resonance tube 722. The first resonance tube 721 extends in a vertical direction serving as an exemplary first direction, takes in from a sound absorbing opening portion a sound wave that is generated from a noise source, and causes the sound wave to resonate to reduce leakage to outside. The second resonance tube 722 extends in a horizontal direction serving as an exemplary second direction differing from the first direction, and, along with the first resonance tube 721, causes the sound wave that is generated from the noise source to resonate to reduce the leakage to the outside.

As illustrated in FIG. 13, the first resonance tube 721 is formed by a first partition portion 731 disposed along the vertical direction of partition walls 730 provided in a substantial L shape in the first duct member 70. An upper end portion of the first resonance tube 721 is open to the upper side, and constitutes a sound absorbing opening portion 724. Also, the second resonance tube 722 is formed of a second partition portion 732 disposed along the horizontal direction of the partition walls 730 provided in the substantial L shape in the first duct member 70. The above-described datum hole 168 of the right side frame 16 is located at a tip end portion along the longitudinal direction of the second resonance tube 722. The datum hole 168 constitutes a communication hole through which the second resonance tube 722 is connected with a third resonance tube 723 (described later).

In addition, a second duct member 90 made of synthetic resin and constitutes an exhaust duct is attached to an outer side surface of the right side frame 16 at a position corresponding to the exhaust fan 165. The second duct member 90 is integrally formed with the exterior body of the exhaust fan 165 at a lower end portion of the exhaust fan 165. The second duct member 90 is formed with a laterally elongated substantially rectangular-parallelepiped shape whose side surface at the right side frame 16 side being open. The second duct member 90 constitutes the third resonance tube 723 that extends in the third direction differing from the first and second directions, and that, along with the first and second resonance tubes 721 and 722, causes the sound wave that is generated from the noise source to resonate to reduce the leakage to the outside. As illustrated in FIG. 15, the third resonance tube 723 is disposed to be adjacent to the second resonance tube 722 with the right side frame 16 interposed therebetween in a substantially horizontal plane.

Consequently, the first resonance tube 721, the second resonance tube 722, and the third resonance tube 723 constitute a single continuous resonance tube. The length of the single resonance tube is the sum of the lengths L1, L2, and L3 of the first to third resonance tubes 721 to 723.

Action of Image Forming Apparatus

In the image forming apparatus 1 according to the exemplary embodiment, even if it is difficult to form a resonance tube only in one direction due to limitation on size, it is possible to form a resonance tube as follows.

In the image forming apparatus 1, when the controlling device 100 receives command information regarding a request for an image forming operation (print), the driving device 80 drives, for example, the image forming unit 2, the sheet-feeding unit 4, the transporting unit 5, and the fixing unit 6. In the image forming apparatus 1, the intake fan (not illustrated) and the exhaust fan 165 are driven in synchronization with an image forming operation.

As illustrated in FIG. 3, in the driving device 80, the driving motor 81 is rotationally driven, and rotational driving force of the driving motor 81 is transmitted to the rotary bodies, such as the photoconductor drum 21 of the image forming unit 2, via, for example, the driving force transmission gears 821 to 830 and 831.

At this time, the driving device 80 generates driving noises resulting from, for example, meshing of the driving force transmission gears 821 to 830 and 831. Of the driving noises resulting from the meshing of the driving force transmission gears 821 to 830 and 831, in particular, the driving noise resulting from the meshing of the driving force transmission gear 831 having a large outside diameter tends to have a low frequency of 1000 Hz or less because the rotation speed of the driving force transmission gear 831 having the large outside diameter is less than the rotation speeds of driving force transmission gears having small outside diameters.

Also, the intake fan (not illustrated) and the exhaust fan 165 generate rotation sounds resulting from driving of the intake fan and the exhaust fan 165. The rotation sounds of the intake fan and the exhaust fan 165 tend to have low frequencies of 1000 Hz or less.

Figure 16:
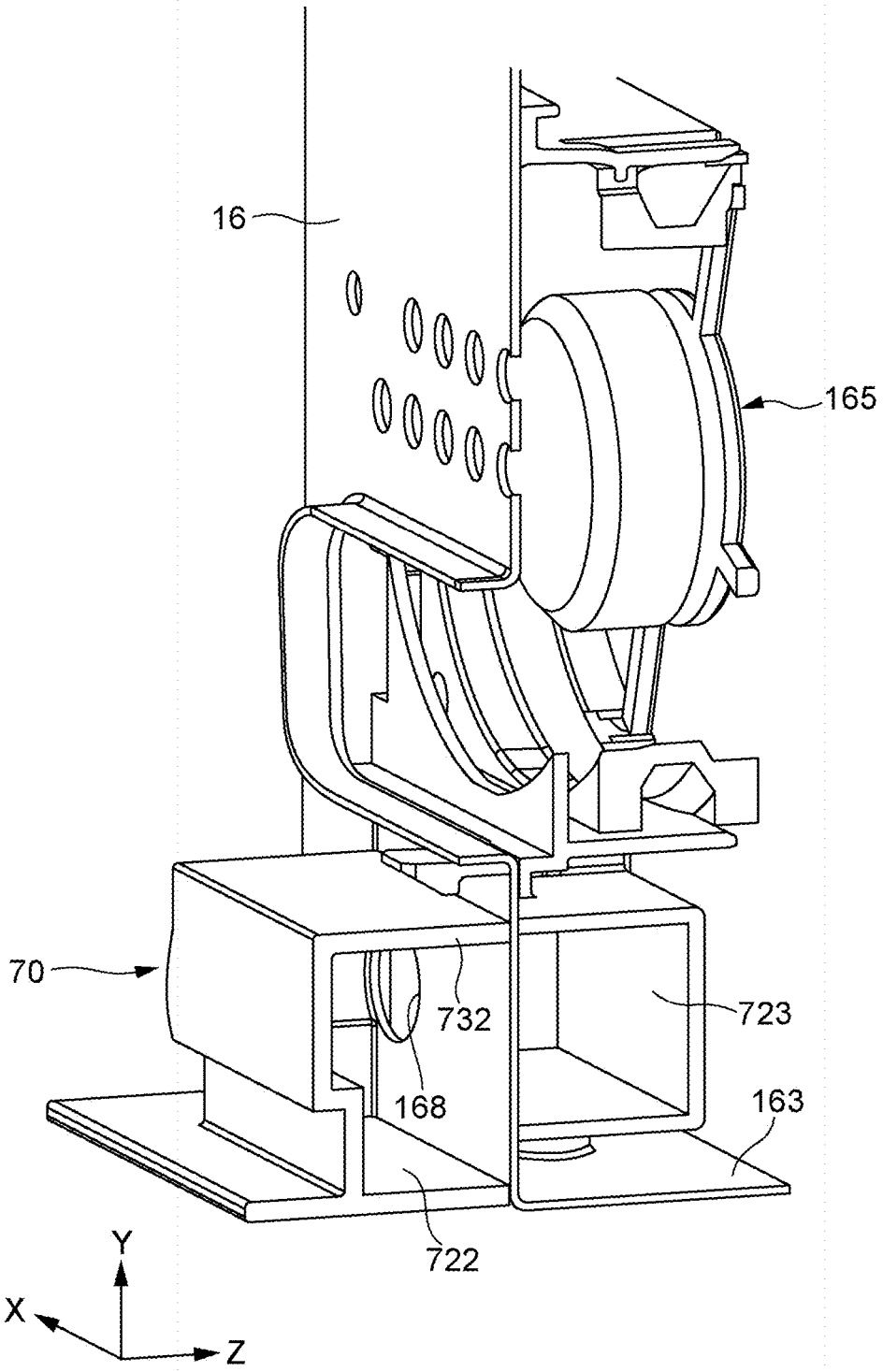
FIG. 16 is a partly cutaway perspective view of a resonance tube.
Figure 17:
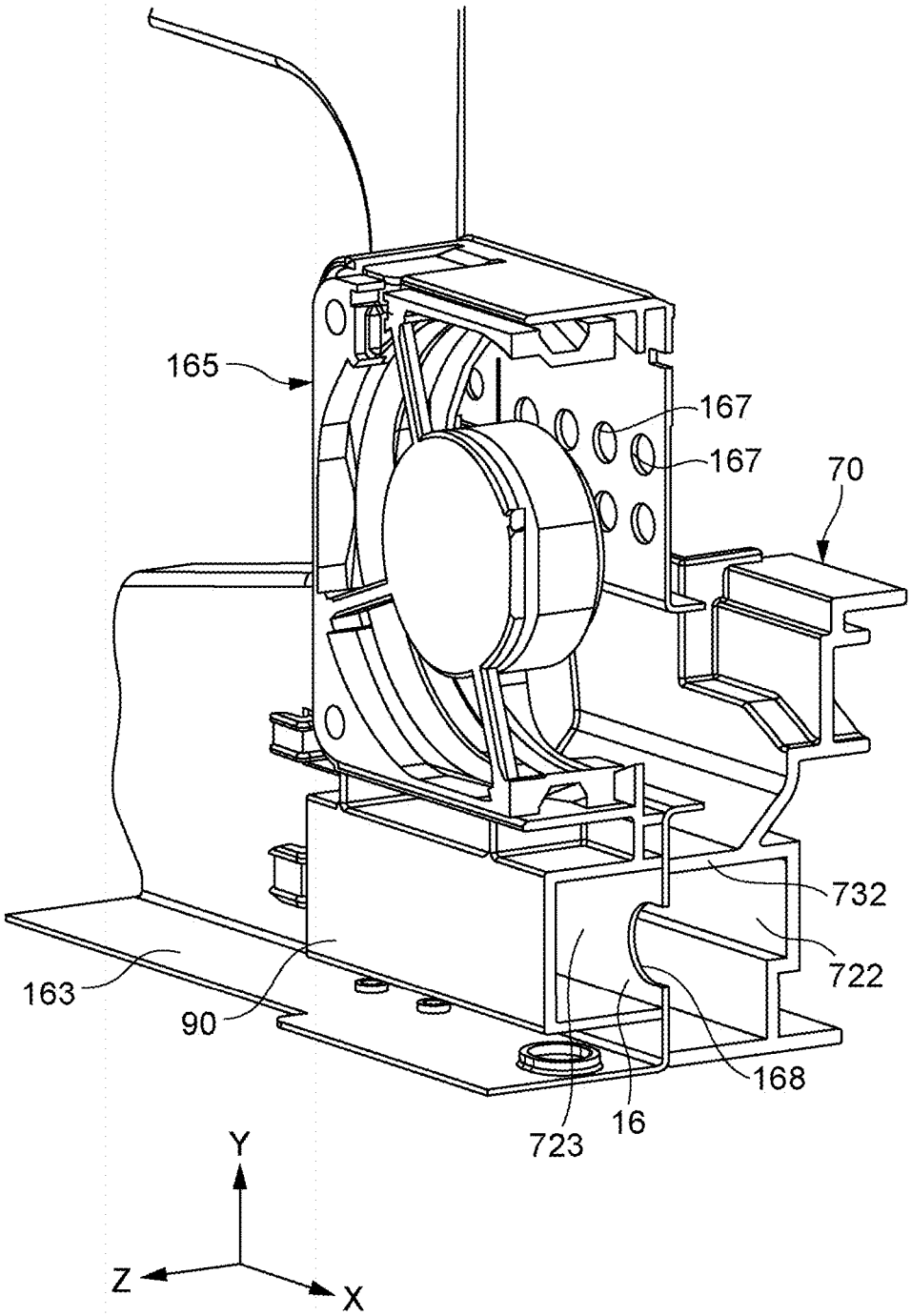
FIG. 17 is a partly cutaway perspective view of the resonance tube.

As illustrated in FIGS. 15 to 17, the noises that are generated from, for example, the driving force transmission gears 821 to 830 and 831 of the driving device 80 are introduced to the inside of the first resonance tube 721 via the opening 724 that functions as the sound absorbing opening portion of the first duct member 70, and a sound at a wavelength λ resonates, the wavelength λ corresponding to the sum of the lengths L1 to L3 of the second and third resonance tubes 722 and 723 continued from the first resonance tube 721. Hence the noises having frequencies of 1000 Hz or less that are generated from the driving device 80 and the air sending sound resonate in the first to third resonance tubes 721 to 723 that function as the single resonance tube although the individual lengths L1, L2, and L3 of the first to third resonance tubes 721 to 723 are small. Output of the noises to the outside of the image forming apparatus 1 is prevented or reduced. Accordingly, even if it is difficult to ensure the length L of a single resonance tube only in one direction for a noise having a relatively low frequency, the resonance tube having the sum of the lengths L1, L2, and L3 in total of the first to third resonance tubes 721 to 723 may be constituted, and a noise having a relatively low frequency is reduced.

Second Exemplary Embodiment

Figure 18:
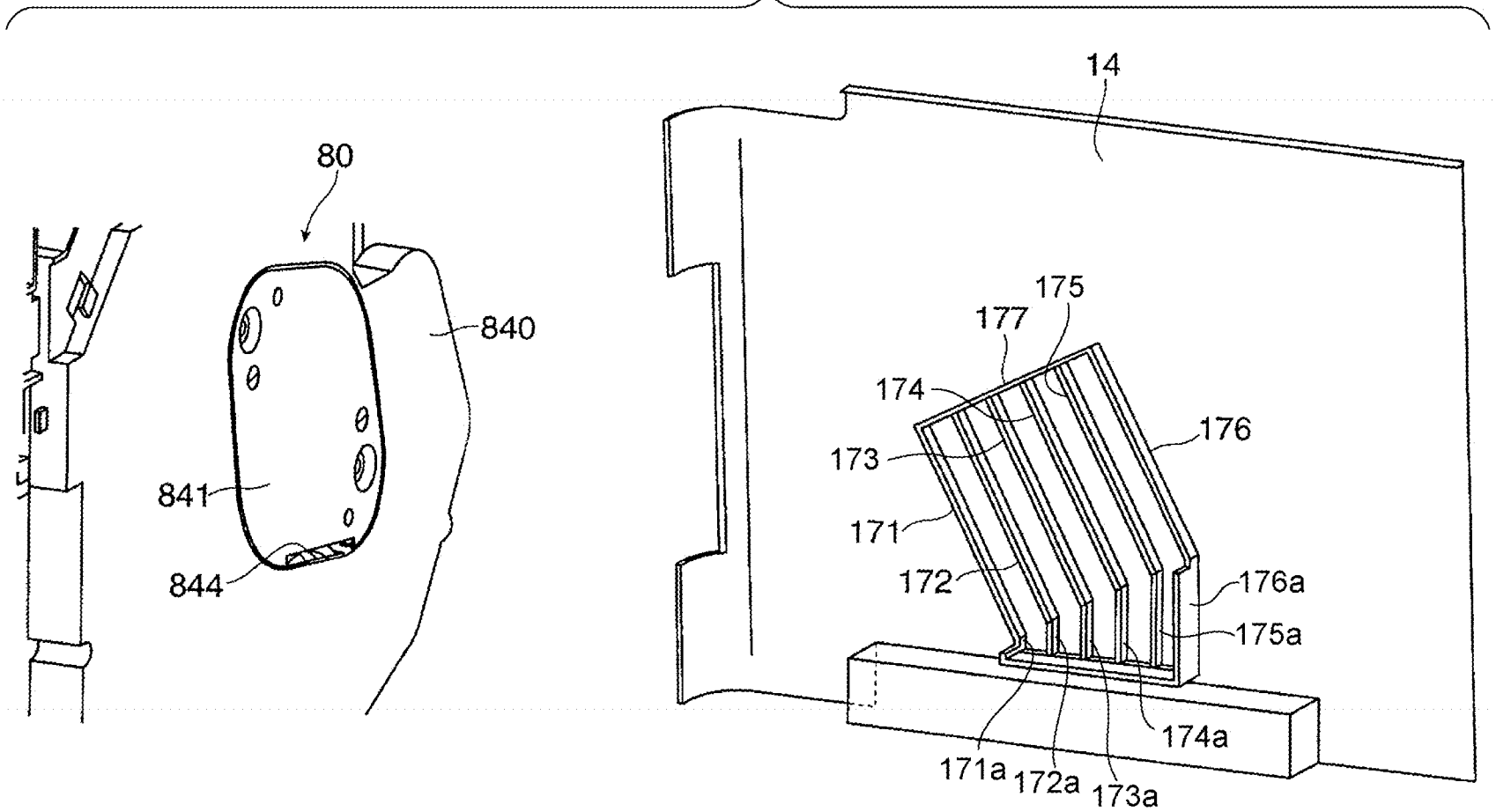
FIG. 18 is a schematic view of a structure of an image forming apparatus to which a noise reducing structure according to a second exemplary embodiment of the present invention is applied.

FIG. 18 schematically illustrates an entire image forming apparatus 1 to which a noise reducing structure according to a second exemplary embodiment is applied.

As illustrated in FIG. 18, the image forming apparatus 1 according to the second exemplary embodiment includes a side cover 14 as an exemplary exterior body. The side cover 14 is openably and closably mounted on an apparatus body 1*a*. The side cover 14 is disposed so as to cover an outer side surface of a driving device 80 of the apparatus body 1*a*. Multiple reinforcing ribs 171 to 176 that are tilted so as to be parallel to each other are integrally formed with an inner side surface of the side cover 14. Spaces that are formed by one end portion of each of the multiple reinforcing ribs 171 to 176 are closed by a reinforcing rib 177. In addition, lower end portions 171*a* to 176*a* of the multiple reinforcing ribs 171 to 176 are bent downward. The multiple reinforcing ribs 171 to 176 including the lower end portions 171*a* to 176*a* constitute a resonance tube. The resonance tube constituted by the multiple reinforcing ribs 171 to 176 have lengths differing from each other by the lengths of the lower end portions 171*a* to 176*a*, and causes multiple sounds with different frequencies to resonate.

By closing the spaces formed by the multiple reinforcing ribs 171 to 177 that are adjacent to each other, the open sides are closed to constitute multiple resonance tubes formed by closed spaces. In this way, by closing the side cover 14, the open sides of the multiple reinforcing ribs 171 to 177 are closed by a housing 840 and a drum supporting cover 841 of the driving device 80. When the lengths of the multiple resonance tubes formed by the multiple reinforcing ribs 171 to 177 are made to differ from each other, it is possible to cause sounds having different wavelengths to resonate. The opening of the driving device 80 constitutes the sound absorbing opening portion of each resonance tube.

Although, in the exemplary embodiments, a monochrome image forming apparatus that forms a black toner image is described as the image forming apparatus, the type of image forming apparatus is not limited thereto. Obviously, as the image forming apparatus, a full-color image forming apparatus that forms toner images of four colors, yellow (Y), magenta (M), cyan (C), and black (K) may also be similarly used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A noise reducing structure comprising:

a first resonance tube that extends in a first direction, that takes in from a sound absorbing opening portion a sound wave that is generated from a noise source, and that causes the sound wave to resonate to reduce leakage to outside;

a second resonance tube that extends in a second direction differing from the first direction, and that, along with the first resonance tube, causes the sound wave that is generated from the noise source to resonate to reduce the leakage to the outside; and a third resonance tube that extends in a third direction differing from the first and second directions, and that, along with the first and second resonance tubes, causes the sound wave that is generated from the noise source to resonate to reduce the leakage to the outside, wherein the first and second resonance tubes are disposed on a substantially plate-shaped member, and the second and third resonance tubes are disposed with the substantially plate-shaped member interposed therebetween.

2. The noise reducing structure according to claim 1, wherein the first and second resonance tubes are disposed so as to intersect each other.

3. The noise reducing structure according to claim 2, wherein the first and second resonance tubes are disposed in a substantial L shape parallel to a plane along a vertical direction.

4. The noise reducing structure according to claim 1, wherein the sound absorbing opening portion of the first resonance tube is disposed so as to face the noise source.

5. The noise reducing structure according to claim 4, wherein a shape of the sound absorbing opening portion of the first resonance tube is substantially the same as a cross-sectional shape of the first resonance tube.

6. The noise reducing structure according to Claim 1, wherein the second and third resonance tubes are connected to each other via an opening that is provided in the substantially plate-shaped member.

7. An image forming apparatus comprising:

the noise reducing structure according to claim 1, wherein the noise source is a driving device that drives an image forming unit.

* * * * *